US006786337B2

(12) United States Patent
Klein et al.

(10) Patent No.: US 6,786,337 B2
(45) Date of Patent: Sep. 7, 2004

(54) WOODEN SHOE RACK CONSTRUCTION

(75) Inventors: Richard B. Klein, Overland Park, KS (US); John W. Scott, Lenexa, KS (US); Chris Serslev, Leawood, KS (US)

(73) Assignee: Lynk, Inc., Lenexa, KS (US)

( * ) Notice: Subject to any disclaimer, the term of this patent is extended or adjusted under 35 U.S.C. 154(b) by 0 days.

(21) Appl. No.: 10/223,905

(22) Filed: Aug. 20, 2002

(65) Prior Publication Data

US 2004/0035806 A1 Feb. 26, 2004

(51) Int. Cl.[7] ..... A47F 7/08

(52) U.S. Cl. ..... 211/34; 211/134; 211/189

(58) Field of Search ..... 211/34, 35–38, 211/194, 201, 87.01, 113, 119, 118, 189, 182; 403/378, 408.1, 396, 347, 382, 256, 258, 253, 260, 262

(56) References Cited

U.S. PATENT DOCUMENTS

| | | | | | |
|---|---|---|---|---|---|
| 1,404,555 | A | * | 1/1922 | Smith | 211/35 |
| 1,450,948 | A | | 4/1923 | Glidden | |
| 1,626,399 | A | * | 4/1927 | Fischer | 211/35 |
| 1,703,190 | A | | 2/1929 | Glidden | |
| 1,724,386 | A | * | 8/1929 | Weston | 211/85 |
| D85,502 | S | | 11/1931 | Wilhelm | |
| 2,067,095 | A | | 1/1937 | Pease | |
| 2,090,108 | A | | 8/1937 | Cicero | |
| 2,152,192 | A | | 3/1939 | Hoffman | |
| 2,238,884 | A | * | 4/1941 | Hoffman | 211/35 |
| 2,270,796 | A | * | 1/1942 | Hauser | 211/119.004 |
| 2,276,141 | A | * | 3/1942 | Atkinson | 211/37 |
| D139,415 | S | * | 11/1944 | Brown | D6/320 |
| 2,712,199 | A | * | 7/1955 | Latimer | 446/106 |
| 3,391,793 | A | | 7/1968 | Streuli | |
| 3,606,023 | A | * | 9/1971 | Edmunds | 211/74 |
| 3,669,033 | A | * | 6/1972 | Murcia | 108/180 |
| 3,748,814 | A | * | 7/1973 | Cribben | 52/668 |
| 3,885,675 | A | * | 5/1975 | Hultenby et al. | 211/118 |
| 3,888,353 | A | * | 6/1975 | Leifheit | 211/37 |
| 3,966,337 | A | * | 6/1976 | Crawford | 403/170 |
| 4,039,132 | A | * | 8/1977 | Fournier | 248/150 |
| 4,232,916 | A | * | 11/1980 | Correia | 312/107 |
| 4,559,657 | A | * | 12/1985 | Whitehead | 5/286 |
| 4,697,713 | A | * | 10/1987 | Pryor | 211/189 |
| 4,981,224 | A | * | 1/1991 | Rushing | 211/126.12 |
| 5,103,985 | A | * | 4/1992 | Davis | 211/37 |
| 5,169,009 | A | * | 12/1992 | Bomze | 211/74 |
| 5,185,982 | A | * | 2/1993 | Hostetler | 52/646 |
| 5,617,959 | A | | 4/1997 | Klein et al. | |
| 5,625,987 | A | * | 5/1997 | Zamerovsky | 52/263 |
| 5,695,073 | A | * | 12/1997 | Klein et al. | 211/35 |
| D398,787 | S | | 9/1998 | Malik | |
| 5,855,279 | A | * | 1/1999 | Klein et al. | 211/35 |
| 5,894,940 | A | * | 4/1999 | Gusdorf et al. | 211/35 |
| 5,992,647 | A | * | 11/1999 | Malik | 211/34 |
| 6,257,427 | B1 | * | 7/2001 | Schneid | 211/189 |
| 6,364,129 | B1 | * | 4/2002 | Dardashti et al. | 211/40 |
| 2003/0085188 | A1 | * | 5/2003 | Klein et al. | 211/118 |

* cited by examiner

*Primary Examiner*—Jennifer E. Novosad
(74) *Attorney, Agent, or Firm*—Shook, Hardy & Bacon L.L.P.

(57) ABSTRACT

A wooden shoe rack constructed either as a unit hung on a door or as a self-standing unit. Frame sides connect with support arms at special dado joints. Shoe support bars extend between the joints on the opposite sides of the frame to support shoes. A single mechanical fastener is used at each joint to connect the frame sides, arms and shoe bars together.

18 Claims, 4 Drawing Sheets

FIG. 4.
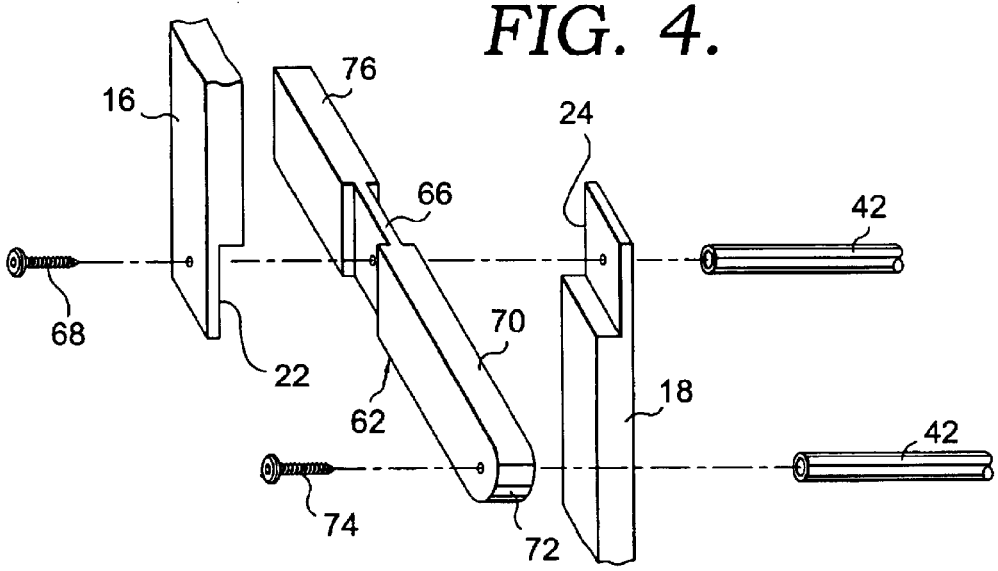
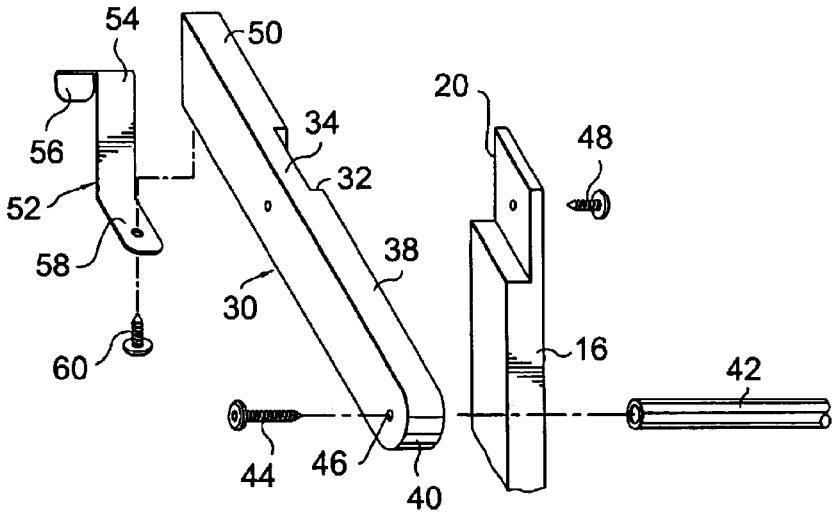
FIG. 5.

WOODEN SHOE RACK CONSTRUCTION

FIELD OF THE INVENTION

This invention relates generally to shoe racks used for the storage of shoes and more particularly to wooden shoe racks having special joints between the different components which are constructed to facilitate assembly by consumers.

BACKGROUND OF THE INVENTION

Various types of shoe racks have been developed in order to accommodate the organized storage of shoes. The shoe racks that have been used include both self-standing units that are supported on the floor and hanging units that hang on doors or other vertical surfaces. Typically, shoe racks of this type are provided with multiple tiers in order to enhance the storage capacity.

Various materials have been used to construct shoe racks, and plastic has been especially popular. Plastic has advantages in several respects, most notably because it is light in weight, inexpensive and easy to handle and package. Wood has the advantage of being generally more aesthetically appealing and is generally considered to be more upscale than plastic.

However, wooden shoe racks are problematic in several respects. First of all, this type of shoe rack is typically a consumer product that is sold mainly in retail stores. Therefore, the shoe rack must be packaged in a disassembled state with the packaged product being as compact as possible. Long pieces of framework and the like are precluded due to the need for compact packaging. Further, the parts must be easily assembled by average consumers. Complicated joints between the different parts are thus unacceptable, as are glue joints and any type of complex fastening system. At the same time, the joints between the parts must be fastened securely in order to adequately hold the unit together, particularly when it is subjected to forces such as those that occur on a door mounted unit when the door is swung open or closed. For economic reasons, the number of different parts should be minimized so that the tooling used for construction of the parts can be as inexpensive as possible.

BRIEF SUMMARY OF THE INVENTION

The present invention has, as its principal goal, the provision of a shoe rack that is constructed of wood and equipped with specially formed joints which allow for quick and simple assembly of the different parts.

More specifically, it is an object of the invention to provide a wooden shoe rack having special joints between the parts that allow a single fastener to connect the frame sides, support arms and cross bars at each joint in a single fastening operation.

Another object of the invention is to provide a shoe rack of the character described wherein the joints do not detract from the aesthetics of the unit.

A further object of the invention is to provide a shoe rack of the character described in which the parts can be quickly and easily assembled without the need for special tools or mechanical skills.

An additional object of the invention is to provide a shoe rack of the character described which has a secure yet easily applied fastening system.

Still another object of the invention is to provide a shoe rack of the character described in which the number of different components is minimized.

Yet another object of the invention is to provide a shoe rack of the character described which can be constructed either as a self-standing unit or as a hanging unit that can be applied to a door or other vertical surface.

A still further object of the invention is to provide a shoe rack of the character described that is constructed in a manner allowing it to be packaged compactly without unduly long pieces.

These and other objects of the invention are achieved by providing a wooden shoe rack having frame sides, support arms and cross bars, all of which may be constructed of wood. The frame sides have dado grooves for receiving tongues of the support arms at joints to which the ends of the bars are also connected. A single mechanical fastener such as a screw is used at each joint to connect the frame, arm and bar together.

In the case of a hanging shoe rack, each frame side can include upper and lower legs connected end to end at a special joint. The support arm which is fastened at this joint includes an inner end portion that acts against the door or other surface to provide a standoff spacing the frame away from the door. Special upper and lower arms provide additional standoffs at the top and bottom ends of the frame. Spacing the frame away from the door has advantages in several respects, including helping to maintain the shoes on the rack, providing clearance of the doorknob, and preventing the shoes from marring the door surface.

In the case of a self-standing shoe rack, each frame side includes a pair of legs that are connected at the bottom by a foot piece and at the top by a rigid brace. Special dado joints are located at each connection between the legs and the feet and braces, with cross bars also connected at these joints by a single fastener.

DESCRIPTION OF THE DRAWINGS

In the accompanying drawings which form a part of the specification and are to be read in conjunction therewith and in which like reference numerals are used to indicate like parts in the various views:

FIG. 4 is an exploded perspective view of the detail shown in FIG. 3;

FIG. 5 is an exploded perspective view of the detail shown in FIG. 2;

DETAILED DESCRIPTION OF THE INVENTION

Figure 1:
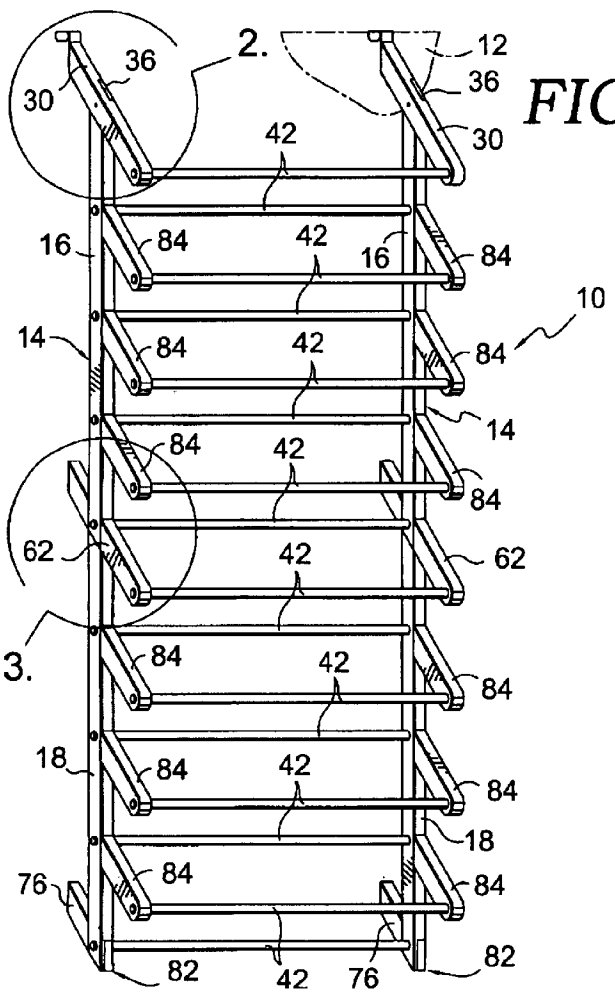
FIG. 1 is a perspective view of a hanging wooden shoe rack constructed according to one embodiment of the present invention.

Referring now to the drawings in more detail and initially to FIG. 1, numeral 10 generally designates a wooden shoe rack constructed in accordance with one embodiment of the present invention. The shoe rack 10 is constructed in a manner allowing it to be hung on the top edge of a door, indicated fragmentarily at 12 in FIG. 1. Alternatively, the shoe rack 10 can be hung on a wall or other vertical surface.

Figure 6:
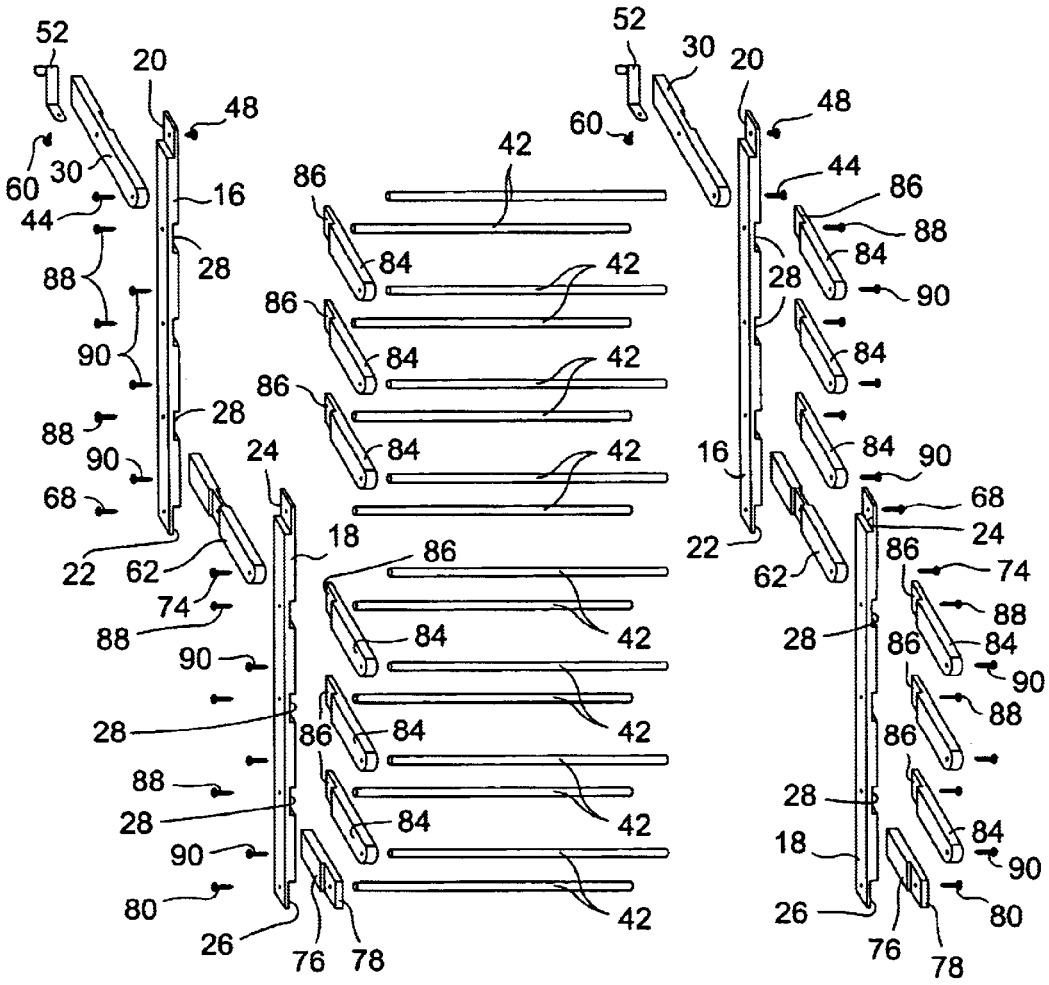
FIG. 6 is an exploded perspective view of the hanging shoe rack shown in FIG. 1.

The shoe rack 10 has a frame that includes opposite frame sides 14 that are constructed identically. The sides 14 are spaced apart and parallel to one another when the shoe rack 10 is assembled. Each side 14 includes an upper leg 16 and a lower leg 18, with the upper leg 16 on each side located above and connected end to end with the lower leg 18 on the same side. The legs 16 and 18 are preferably constructed of wood, although other materials can be used. As best shown in FIG. 6, each upper leg 16 is provided at its top end with a recess or groove 20 and at its lower end with another recess or groove 22. Each lower leg 18 is similarly provided with a groove 24 at its upper end and another groove 26 at its lower end. Each of the legs 16 and 18 is provided with a plurality of intermediate grooves 28. The grooves 28 are spaced apart substantially equidistantly from one another and from the upper and lower grooves of the legs 16 and 18. Each of the legs 16 and 18 may have an identical construction.

The shoe rack 10 includes a plurality of support arms, including an upper support arm 30 for each of the frame sides 14. As best shown in FIG. 5, each of the upper support arms 30 is provided at an intermediate location with a recess 32 to form a reduced thickness tongue 34 adjacent to the recess 32. The width of the tongue 34 is the same as the depth of the groove 20 so that the tongue 34 can be closely received in the groove 20 without presenting a jog or other abrupt dimensional change at the area of the joint 36 (see FIG. 2) between the leg 16 and the upper support arm 30.

Figure 2:
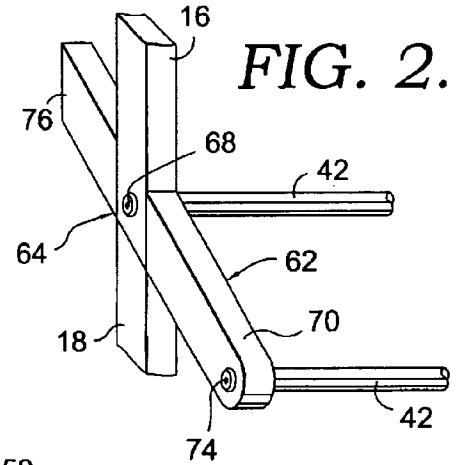
FIG. 2 is a fragmentary perspective view on an enlarged scale of the detail identified by numeral 2 in FIG. 1.

With reference to FIGS. 2 and 5 in particular, each of the upper support arms 30 includes an outer end portion 38 which projects outwardly from the tongue 34 and terminates in a rounded free end 40. The shoe rack 10 includes a plurality of cross bars 42 which serve as shoe bars for receiving shoes applied to the shoe rack. The bars 42 preferably take the form of metal tubes, although wood, plastic and other materials can be used. One of the bars 42 is connected at one end with the outer end portion 38 of each upper support arm 30 adjacent to the rounded end 40. A mechanical fastener such as a screw 44 may be applied through an opening 46 (see FIG. 5) formed in the outer end of each arm 30 and threaded into the adjacent end of the bar 42 in order to secure the bar to the support arm. Another fastener such as a wood screw 48 may be threaded from the inside through the upper end portion of each leg 16 and into the tongue 34 in order to secure the upper support arm 30 to each frame side 14 at the joint 36.

Each support arm 30 has an inner end portion 50 that extends inwardly from the tongue 34. A hanger bracket 52 is secured to the end of each inner end portion 50. Each bracket 52 has an L-shaped body 54 to fit over the upper edge of the door 12. A downturn flange 56 is also provided on the body 54 to fit against the door surface in order to stabilize the suspension of the shoe rack 10 on the door 12. Each bracket 52 has a projecting flange 58 that fits against the underside of the inner end portion 50 of each support arm 30. A fastener such as a screw 60 may be extended upwardly through the flange 58 and threaded into the underside of the support arm 30 in order to secure the bracket 52 to the end of the support arm. When the shoe rack 10 is applied to the door 12, the projecting inner end portions 50 of the upper support arms 30 serve as standoffs to space the frame sides 16 away from the surface of the door 12.

Figure 3:
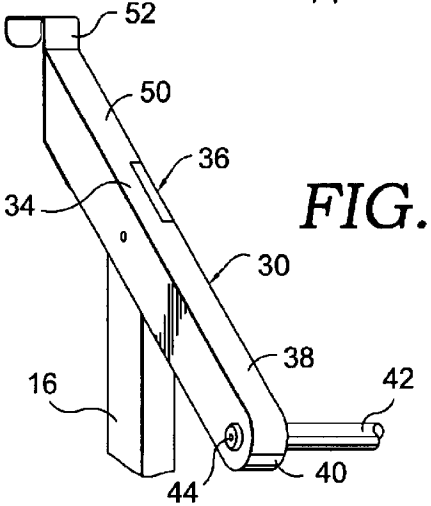
FIG. 3 is a fragmentary perspective view on an enlarged scale of the detail identified by numeral 3 in FIG. 1.

With reference to FIGS. 3 and 4 in particular, the shoe rack 10 has a pair of specially constructed center support arms 62 which are connected at special joints 64 (FIG. 3) located where the upper and lower arms 16 and 18 are connected with one another on each of the frame sides. As shown in FIG. 4, each support arm 62 is recessed at an intermediate location on both of its sides in order to provide a tongue 66 which fits in the grooves 22 and 24 when the shoe rack is assembled. A mechanical fastener such as a wood screw 68 is applied through the lower end of each upper leg 16, through the tongue 66, through the upper end of each lower leg 18 and into the end of one of the cross bars 42 in order to secure the upper and lower legs 16 and 18 to one another and to secure the support arm 62 to the frame side, as well as to secure the cross bar 42 in extension between the opposite frame sides 14. All of these components are connected together at each of the joints 64 through the use of a single fastener 68 and a single fastening operation.

Each of the arms 62 has an outer end portion 70 which extends outwardly from the tongue 66 and terminates in a rounded outer end 72. A fastener such as a screw 74 is extended through the outer end portion of each arm 62 and threaded into the end of one of the bars 42 in order to secure the bar in extension across the shoe rack between the two arms 62 adjacent to their outer ends.

Each of the arms 62 has an inner end portion 76 which extends inwardly from the tongue 66. Similarly to the end portions 50 of the upper support arms 30, the inner end portions 76 of arms 62 serve as standoffs to space the frame sides 14 outwardly from the surface of the door 12.

With particular reference to FIG. 6, a pair of lower support arms 76 are included in the shoe rack, one for each side of the unit. Each of the arms 76 is provided at its outer end with a tongue 78 that fits closely in the groove 26 on the lower end of each lower leg 18. A fastener such as a wood screw 80 is inserted through the lower end of each leg 18, through the tongue 78 of the adjacent arm 76 and into the end of one of the cross bars 42, thereby securing the lower arms 76 to the frame side and securing the lower cross bar 42 in extension between the opposite frame sides. This connection is made with a single fastener 80 such as a screw applied at a joint 82 (see FIG. 1) formed at the bottom of each side 14. The lower arms 76 project inwardly from each frame side 14 to serve as standoffs spacing the frame sides outwardly from the door 12 in the same manner described in connection with arms 30 and 62.

In addition to the pairs of upper arms 30, center arms 62 and lower arms 76, the shoe rack includes a plurality of support arms 84 which are identical to one another. As best shown in FIG. 6, each support arm 84 has on its inner end a tongue 86 that may be fitted closely in a corresponding groove 28. A single fastener such as a screw 88 is used to connect each of the arms 84 with the frame sides 14 at joints formed between the arms 84 and the upper and lower legs 16 and 18 of the frame sides. Each of the fasteners 88 is also threaded into the end of a cross bar 42, thereby securing the bar 42 in extension between the opposite sides of the frame. In this manner, a single fastener 88 secures each arm 84 to the frame and also secures the bar 42 to the frame.

Each arm 84 extends outwardly from the frame side 14 and has a free outer end that receives a fastener such as a wood screw 90 used to secure additional bars 42 in extension between outer ends of the arms 84.

Each of the support arms inclines downwardly as it extends outwardly from the frame side 14. The cross bars 42 extending between the outer ends of the arms are horizontal and are at an elevation slightly above the corresponding bar 42 that extends between the frame sides 14 at the location of the joints at which the next lower pair of arms are connected. Shoes (not shown) can be mounted on the pairs of bars 42, with the outer end of each shoe elevated above the inner end of the shoe so that the shoe cannot fall outwardly off of the shoe rack due to its inclined orientation which maintains the inner end of the shoe against the door 12. Further, the shoes are blocked both by the support arms and by the frame sides 14 from sliding sidewardly off of the shoe rack 10, as could otherwise occur due to the forces applied when the door 12 is swung open or closed.

It is noted that the upper arms 30 have only a single bar 42 associated with them, and it extends between their outer ends. This bar and the bar 42 that extends between the frame sides 14 at the location of joints between the uppermost arms 84 provide for the support of the upper tier of shoes. The lower arms 76 are associated with only the lowermost bar 42 which extends between the frame sides 14. This bar 42 and the bar 42 extending between the outer ends of the lowermost pair of arms 84 provides for storage of the lower tier of shoes on the rack 10.

By virtue of the joint construction of the shoe rack 10, a single fastener is provided at each joint between each pair of support arms and the frame sides. The same fastener is used for connection of the bars 42. Additionally, the central joint 64 between the upper and lower legs connects the upper and lower legs together as well as connecting the arm 62 and the associated bar 42.

The frame sides 14 and the support arms 30, 62, 76 and 84 are preferably constructed of wood, although other suitable materials can be used. The frame legs 16 and 18 are all identical to each other, as are the bars 42, so there are only six different pieces in the shoe rack. This facilitates its manufacture and minimizes the cost.

The hanging shoe rack 10 has been described as including pairs of upper legs 16 and lower legs 18. However, a lesser or greater number of legs can be provided on each frame side 14 and can be connected in the manner described for the shoe rack 10. The legs 16 and 18 (as well as additional legs if provided) can be connected together to form a relatively lengthy frame side 14 but can be disassembled to a relatively short length so that the carton or other package in which the shoe rack components are packaged is not unduly long.

Figure 7:
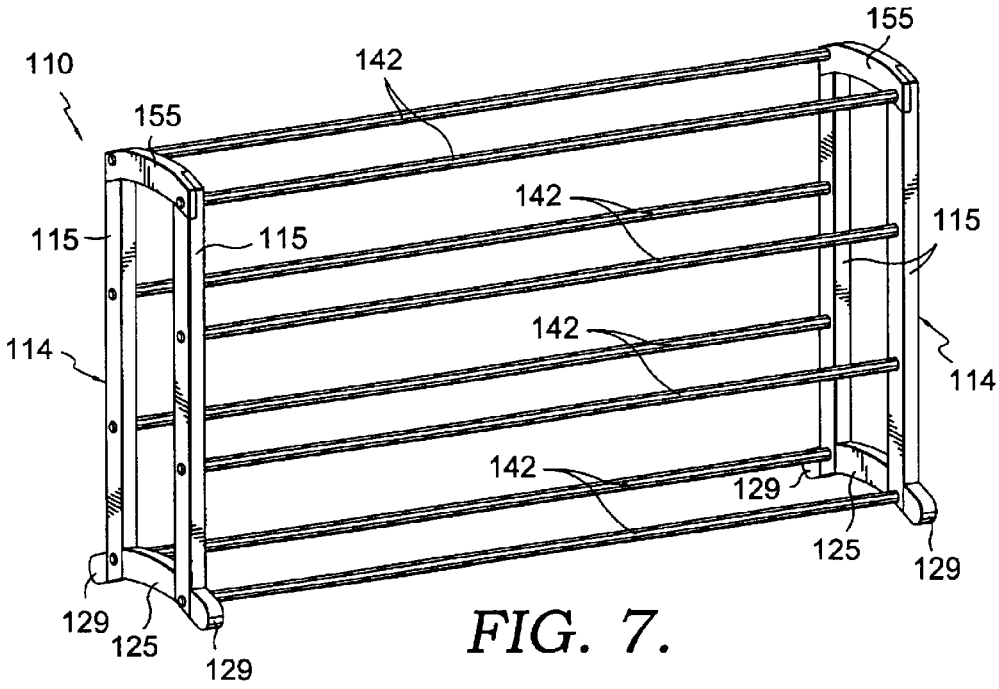
FIG. 7 is a perspective view of a self-standing wooden shoe rack constructed according to another embodiment of the present invention.
Figure 8:
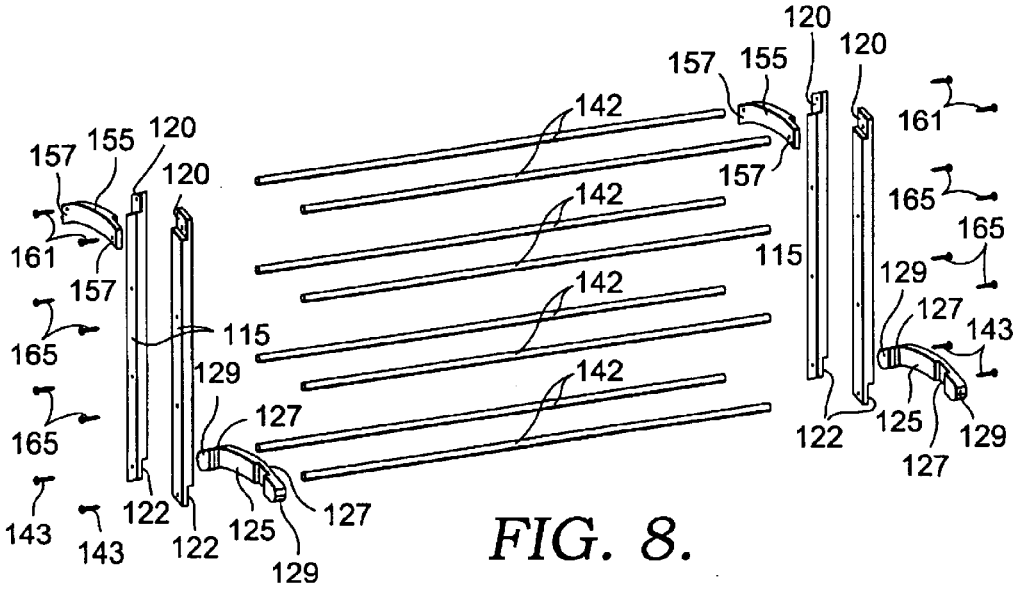
FIG. 8 is an exploded perspective view of the shoe rack shown in FIG. 7.

FIGS. 7 and 8 illustrate a shoe rack 110 which is constructed according to another embodiment of the present invention. Rather than being a hanging shoe rack, the shoe rack 110 is a self-standing unit that rests on a horizontal surface such as a floor.

The shoe rack 110 includes opposite frame sides generally designated by numeral 14 and each including a pair of legs 115. The legs 115 are all constructed identically to one another, and the legs on each frame side 114 extend vertically and parallel to one another when the shoe rack 110 is assembled. As shown in FIG. 8, each leg 115 is provided at its top end with a groove 120 and at its lower end with a groove 122.

A lower support arm for each side 114 is provided by an arcuate base piece or foot 125. Each of the feet 125 is provided with a pair of cutouts that form tongues 127 having a size and shape to fit closely in the lower grooves 122. The feet 125 have rounded end portions 129 that rest on the floor or other supporting surface for support of the shoe rack 110 thereon.

The shoe rack 110 has a plurality of cross bars 142 on which shoes may be received and stored. The bars 142 may take the form of metal tubes, although the can be constructed of another material. At each of the joints in which one of the tongues 127 fits closely in one of the grooves 122, a single fastener such as a screw 143 serves to fasten the foot 125 to the leg 115 and is also threaded into the end of one of the bars 142 in order to secure the bar to the foot and the leg. In this manner, the lower bars 142 are secured to extend between opposite sides of the frame between the opposing feet 125.

The shoe rack 110 also includes an upper support arm for each frame side that may take the form of an arcuate brace 155. Each of the braces 155 is provided on its opposite ends with tongues 157 that fit closely in the upper grooves 120 of legs 115. At each joint at which one of the tongues 157 fits in one of the grooves 120, a single fastener such as a wood screw 161 is used to secure the brace 155 to the leg 115 and is also threaded into the end of one of the bars 142 to secure the bar to the frame side 114 and the brace 155. The bars 142 that are secured in this manner to the braces 155 receive and store the upper tier of shoes applied to the shoe rack 110. The two upper bars 142 are parallel to one another and preferably at the same elevation so that the shoes are received on them in a level orientation.

Between the lower pair of bars and the upper pair of bars, additional tiers of bars 142 are included in the shoe rack. These intermediate bars 142 may be secured in extension between the legs 115 by fasteners such as wood screws 165 extended through the frame legs 115 and into the ends of the intermediate bars 142. The intermediate bars 142 are arranged in pairs which are parallel to and level with one another to provide intermediate tiers for storing shoes.

As with the shoe rack 10, the shoe rack 110 provides joints between the parts that are secured with a single fastener at each joint, thus avoiding glue joints and other complicated joint constructions. Furthermore, as with the shoe rack 10, the shoe rack 110 can be easily assembled and, when disassembled, can be compactly packaged in a relatively small carton, box or other container.

The legs 115, feet 125 and braces 155 may all be constructed of wood, although other materials may be used. The legs, braces, feet and bars are all identical, so only four different parts are required, thus minimizing the manufacturing costs and difficulties.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A shoe rack comprising:

a pair of spaced apart frame sides each having a plurality of grooves, each of said frame sides including an upper leg and a lower leg arranged end to end;

a plurality of support arms each having a tongue received in one of said grooves to provide joints between said frame sides and arms;

said upper leg having a lower end presenting a groove receiving a tongue on a selected support arm and said lower leg having an upper end presenting a groove receiving said tongue on said selected support arm;

a plurality of cross bars arranged in pairs to receive and support shoes thereon, at least some of said bars extending between said frame sides at said joints; and a fastener for at least some of said joints applied in a manner to fasten said frame sides and arms together and to fasten said bars to said frame sides and arms, one of said fasteners being applicable to fasten said tongue of said selected support arm to said upper and lower legs and to fasten one of said bars to said selected support arm and said upper and lower legs.

2. A shoe rack as set forth in claim 1, wherein:

said shoe rack is applicable to a door;

said selected support arm has an outer end portion for connection to one of said bars; and said selected support arm has an inner end portion for application to said door to space the frame sides away from said door.

3. A shoe rack as set forth in claim 2, including:

an upper end of said upper leg presenting a groove;

an upper support arm having a tongue fitting in said groove of said upper end of said upper leg;

an outer end portion of said upper support arm for connection to one of said bars; and an inner end portion of said upper support arm for application to said door to space the frame sides away from said door.

4. A shoe rack as set forth in claim 3, including:

a lower end of said lower leg presenting a groove;

a lower support arm having a tongue fitting in said groove of said lower end of said lower leg; and an inner end portion of said lower support arm for application to said door to space said frame sides away from said door.

5. A shoe rack as set forth in claim 3, including a hanger bracket on said inner end portion of said upper support arm applicable to the door to hang said frame sides thereon.

6. A shoe rack as set forth in claim 2, wherein said frame sides and support arms are constructed of wood.

7. A shoe rack as set forth in claim 1, wherein said shoe rack is a self-standing unit and said frame sides and support arms are constructed of wood.

8. A shoe rack as set forth in claim 1, wherein:

each of said frame sides includes a pair of substantially vertical legs each having an upper end portion and a lower end portion;

said grooves are located in said upper and lower end portions of said legs; and said support arms include a foot for each frame side, said feet being connected by said fasteners to extend between said lower end portions of said legs and resting on a substantially horizontal support surface.

9. A shoe rack as set forth in claim 8, wherein said support arms include a brace for each frame side extending between said upper end portions of said legs and fastened thereto by said fasteners.

10. A shoe rack for support on a door, comprising:

a pair of opposing frame sides spaced apart from one another and supported on said door, each frame side having a plurality of grooves and each frame side including upper and lower legs arranged end to end;

a plurality of support arms connected with each frame side each having an outer end portion and an inner end portion presenting a tongue applicable in one of said grooves, thereby forming joints between the frame sides and arms;

said upper leg having a lower end presenting a groove receiving a tongue on an intermediate support arm and said lower leg having an upper end presenting a groove receiving said tongue on said intermediate support arm;

a plurality of cross bars for supporting shoes thereon, some of said bars extending between said joints on the opposing frame sides and other of said bars extending between and being fastened to said outer end portions of said arms; and a fastener for each joint, said fasteners being applied to connect said arms to said frame sides and said some bars to said frame sides and arms with a single fastener at each joint, one of said fasteners being applicable to fasten said upper and lower legs to each other and to said tongue of said intermediate support arm and to fasten one of said bars to said legs and said intermediate support arm.

11. A shoe rack as set forth in claim 10, wherein:

each frame side has upper and lower ends each having a groove therein;

said support arms include an upper arm for each side fastened to said upper end thereof and having an inner end and a lower arm for each side fastened to said lower end thereof; and said upper arm is provided on the inner end thereof with a hanger bracket for hanging said frame sides on a door.

12. A shoe rack as set forth in claim 11, wherein:

each of said lower arms has an inner end; and said inner ends of said upper and lower arms are applicable to the door to space said frame sides away from the door.

13. A shoe rack as set forth in claim 12, wherein said support arms include an intermediate arm having an inner end applicable to the door to space the frame sides away from the door.

14. A shoe rack as set forth in claim 10, wherein said intermediate support arm has an inner end applicable to said door to space said frame sides away from the door.

one of said fasteners is applicable to fasten said upper and lower legs to each other and to said tongue of said intermediate support arm and to fasten one of said bars to said legs and said intermediate support arm.

15. A shoe rack as set forth in claim 10, wherein said frame sides and said support arms are constructed of wood.

16. A shoe rack for hanging on a door, comprising:

a pair of opposing frame sides spaced apart from one another and constructed to be hung on said door, each frame side having a plurality of grooves;

a plurality of support arms connected with each frame side each having an outer end portion and an inner end portion presenting a tongue applicable in one of said grooves, thereby forming joints between the frame sides and arms, said support arms including an upper arm on each frame side hung on the door and lower and intermediate arms on each frame side having inner ends applicable to the door to space said frame sides away from the door;

a plurality of cross bars for supporting shoes thereon, some of said bars extending between said joints on the opposing frame sides and other of said bars extending between and being fastened to said outer end portions of said arms; and a fastener for each joint, said fasteners being applied to connect said arms to said frame sides and said some bars to said frame sides and arms with a single fastener at each joint.

17. A shoe rack comprising:

a pair of spaced frame sides each having a plurality of grooves;

a plurality of support arms having a tongue received in one of said grooves to provide joints between said frame sides and arms;

a plurality of cross bars arranged in pairs to receive and support shoes thereon, at least some of said bars extending between said frame sides at said joints; and a fastener for at least some of said joints applied through said frame sides and arms and into said bars in a manner to fasten said frame sides and arms together and to fasten said bars to said frame sides and arms.

18. A shoe rack for support on a door, comprising:

a pair of opposing frame sides spaced apart from one another and supported on said surface, each frame side having a plurality of grooves;

a plurality of support arms for each frame side each having a free outer end portion and an inner end portion presenting a tongue applicable in one of said grooves, thereby forming joints between the frame sides and arms;

a plurality of cross bars for supporting shoes thereon, some of said bars extending between said joints on the opposing frame sides and other of said bars extending between and being fastened to said free outer end portions of said arms with said free outer end portions being connected only with said bars; and a fastener for each joint, said fasteners being applied to connect said arms to said frame sides and said some bars to said frame sides and arms with a single fastener at each joint.

* * * * *